US005138948A

United States Patent [19]

La Mura et al.

[11] Patent Number: 5,138,948

[45] Date of Patent: Aug. 18, 1992

[54] HERMETICALLY SEALED PYROTECHNIC DEVICE

[75] Inventors: Joseph L. La Mura, W. Caldwell; Ronald C. Wallenburg, Pennsauken, both of N.J.

[73] Assignee: Joanell Laboratories, Inc., Livingston, N.J.

[21] Appl. No.: 538,774

[22] Filed: Jun. 15, 1990

[51] Int. Cl.[5] ..... F42B 4/00

[52] U.S. Cl. ..... 102/335; 102/202.11; 102/202.14; 86/20.1

[58] Field of Search ..... 102/202.11, 335, 355, 102/202.5, 202.9, 202.14; 86/20.1, 20.14

[56] References Cited

U.S. PATENT DOCUMENTS

| | | | |
|---|---|---|---|
| 307,071 | 10/1884 | Russell | 102/202.9 |
| 317,409 | 5/1885 | Monfort | 102/202.9 |
| 1,354,100 | 9/1920 | Grant et al. | 102/202.9 |
| 2,331,007 | 10/1943 | Taylor et al. | 102/202.9 |
| 3,779,167 | 12/1973 | Irish, Jr. et al. | 102/202.9 |
| 4,130,060 | 12/1978 | Murray | 102/202.9 |
| 4,448,130 | 5/1984 | Speer | 102/335 |
| 4,621,578 | 11/1986 | Vallieres et al. | 102/202.9 |

*Primary Examiner*—J. W. Eldred

[57] ABSTRACT

A cylindrical metal end cap is formed over one end of a thermoplastic tubular casing. A pyrotechnic detonator is ohmically connected to the end cap via an aperture thereof and includes an electrically activated match. The detonator is soldered to the end cap with a solder ring simultaneously with the insertion of the detonator into the end cap aperture to form a hermetic seal. A thermoplastic end cap is heat welded to the other end of the casing to hermetically seal the pyrotechnic material within the casing. The heat welding occurs at the outer surface of the casing and at a temperature lower than the ignition temperature of the pyrotechnic material in the casing. The position of the match within the casing is selected to cause the pyrotechnic material to burn toward the metal end cap to enhance flash production, different length casings producing different flash intensities.

18 Claims, 2 Drawing Sheets

HERMETICALLY SEALED PYROTECHNIC DEVICE

This invention relates to pyrotechnic devices, and more particularly, to weapons simulation devices.

Of interest is copending application Ser. No. 383,650 filed Jul. 24, 1989, entitled Electrically Activated Detonator with Pyrotechnic Device Receiving Terminals and Method of Making in the name of the present inventors and assigned to the assignee of the present invention. This application has issued as U.S. Pat. No. 4,951,570 and is incorporated by reference herein.

Electrically activated detonators, sometimes referred to as initiators, are used to ignite pyrotechnic devices. Such devices are in certain instances used to simulate weapons for the purpose of troop training and the like. Weapons simulators are used to generate flash and smoke. Live ammunition is not used because of the danger to personnel and also because of high cost. The simulators need only produce sufficient smoke and flash for observation. The simulator represents a "hit" of a fired weapon on a target. Present simulation systems may employ electronic sensors at the target for sensing a "hit" and in response to the sensed "hit" ignite the pyrotechnic device.

In some cases it is desired to observe simulated weapons at distances of several thousand feet or more. For example, tank cannons have relatively long ranges. It is desired that the personnel at the firing weapon observe visually when the target has been hit. When the target is at distant locations the pyrotechnic device is required to emit a sufficiently large flash and smoke for such observation. Present pyrotechnic device weapon simulators do not have such long range visibility capability.

Additionally, prior detonators are typically of the impact type which are generally unreliable. Further, these detonators include pyrotechnic material ignited by impact and for this reason the material is typically located close to one end of the casing. Upon ignition, the pyrotechnic material burns from this one end toward the other end. This is acceptable in live ammunition in order to force a projectile from the casing opposing end. In simulation devices, however, this burning action tends to blow the pyrotechnic material out of the casing before fully burned due to the absence of the force fitted projectile at the device end opposite the detonator. This construction makes large flashes sufficient to observe at great distances relatively difficult to achieve. Electrically activated devices ignite at a region close to the casing detonator end and therefore exhibit the same problem.

A further problem is one where pyrotechnic devices need to have long shelf life, e.g., several years. Detonators, especially the impact type, comprise metal cylinders which are force fitted into metal cylindrical apertures of the casing. While this provides a good mechanical connection, it is not a hermetic seal. Typical detonators are not hermetically sealed. A still further problem is that in weapons simulation devices hermetic seals of the casing ends opposing the detonator end are not employed. The ends usually are enclosed with paper or other porous material which permit moisture to penetrate and deteriorate the device.

In prior art ammunition devices, the projectile end is enclosed first, the pyrotechnic material added through the detonator aperture and then the detonator is mechanically installed. It is generally believed to be not safe to add heat to the device for the purpose of sealing the device as this may cause the pyrotechnic material to prematurely ignite.

The present inventors recognize that if the detonator pyrotechnic material were spaced from the metal casing end, the pyrotechnic material will burn in a direction toward the metal casing and would not blow itself out of the casing before full burn occurs. This insures maximum flash with a minimum amount of pyrotechnic material. The present inventors further recognize that the detonator end can be initially sealed with a solder joint, the casing filled with pyrotechnic material and then the other end sealed with a thermoplastic heat weld. A thermoplastic heat weld process has a lower temperature than the ignition temperature of the typical pyrotechnic material used and therefore does not prematurely ignite the material.

A pyrotechnic device according to one embodiment of the invention comprises a tubular casing for containing pyrotechnic material and a pyrotechnic detonator having a pyrotechnic portion and a terminal portion secured to the casing at one end of the casing. Pyrotechnic material is in the casing in contact with the initiator pyrotechnic portion. Means enclose the other end of the casing and means position the detonator pyrotechnic portion spaced from the casing one end such that the pyrotechnic material burns initially towards the terminal portion.

A pyrotechnic device according to a second embodiment comprises a tubular casing for receiving a pyrotechnic detonator at one end thereof and pyrotechnic material in an interior portion. The casing has a metal cap over the one end. Pyrotechnic material is within the casing and a detonator is secured to the metal cap with a pyrotechnic portion positioned in the casing interior. Means hermetically seal the detonator to the cap. An end cap hermetically seals the casing at an end thereof opposite the one end for hermetically sealing the interior portion from the ambient atmosphere.

A method of making a pyrotechnic device according to a further embodiment of the invention comprises forming a thermoplastic tubular casing with opposing ends and attaching a metal end cap with an aperture over one end of the casing. A pyrotechnic detonator is secured in ohmic contact with the end cap in the aperture and then hermetically sealing the detonator to the end cap followed by placing pyrotechnic material in the casing. The other end of the casing is then hermetically sealed.

IN THE DRAWING

Figure 1:
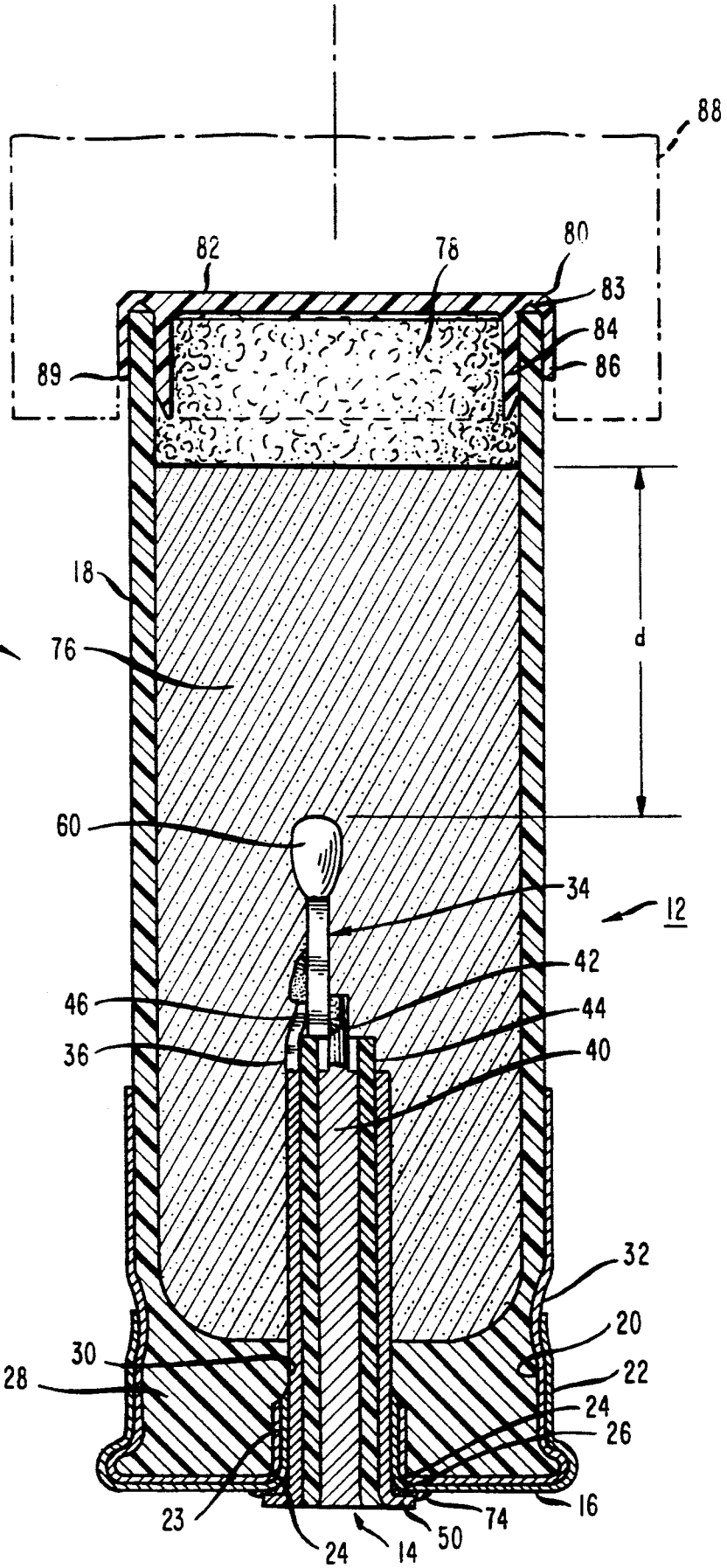
FIG. 1 is a sectional elevation view of a pyrotechnic device according to one embodiment of the present invention.

In FIG. 1, pyrotechnic device 10 includes a flash and smoke cartridge assembly 12 which may be used, in the alternative, to produce smoke or flash and smoke. An electrically activated pyrotechnic detonator 14 is secured to the assembly 12 to form device 10. Detonator 14 is described more fully in the aforementioned copending patent application incorporated by reference herein. The cartridge assembly 12 includes a casing comprising a metal, e.g., brass, cup shaped cap 16 and a tubular insert 18. The cap and insert are commercially available as an assembly. The cap 16 comprises a stamped inner member 20 and a mating outer member 22. The cap 16 is bent inwardly in the central region to form a depending cylindrical sleeve 23 having a detonator receiving aperture 24. The aperture 24 has an enlarged opening 26 at its egress.

The insert 18 is an elongated circular cylindrical member having a thickened end 28 and a central aperture 30. The insert 18 is crimped to the cap 16 at crimp 32. By way of example the cap may be about one inch in diameter and has a length of about $\frac{7}{8}$ inch. The insert has a length of about 2.5 inches.

Figure 2:
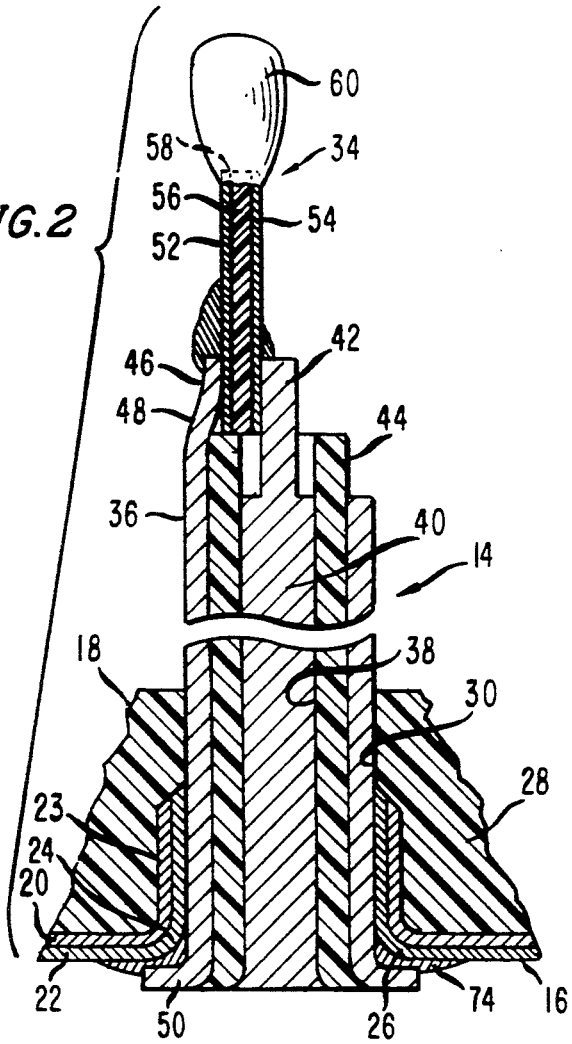
FIG. 2 is a view similar to the view of FIG. 1 showing the detonator in more detail.

In FIG. 2, the detonator 14 includes an electrically activated match 34, a tubular metal jacket 36, a heat shrinkable thermoplastic electrical insulation tube 38 and a central terminal member 40. Member 40 is preferably a solid metal circular cylinder, for example brass. Member 40 has an integral terminal 42 extending from one end of the member. Tube 38 is heat shrunk over the longitudinal outer surface of member 40. The length of tube 38 is greater than that of member 40 such that tube 38 extends beyond the end of member 40 to form a leader 44. The leader 44 permits the tube 38 and member 40 assembly to be forced into the bore of jacket 36 without the tube and leader slipping out of position. The tube is compressed somewhat and stretched by this action. The stretching elongates and thins the tube somewhat and forms a good hermetic seal between the mating surfaces due to the compressive sealing action of the pliable tube. The tube 38 may be PVC. The tube mechanically locks the member 40 to the jacket 36.

Terminal 46 is formed from jacket 36 and is integral with the jacket, which may be brass. Terminal 46 is an elongated sheet metal tab having a bend 48 to position the end of the terminal 46 parallel to terminal 42 and in spaced relation to terminal 42. Jacket 36 also has an annular flange 50 formed integral therewith at an end opposite terminal 46. The flange 50 is dimensioned to mate somewhat with the enlarged egress of aperture 24. The outer diameter of jacket 36 is dimensioned to be in closed fitting engagement with the walls of aperture 24 of the cap 16 and aperture 30 of insert 18. However, this tight fit of the jacket with the aperture walls does not provide a hermetic seal. A hermetic seal is required in certain implementations in which long shelf life is desired. The outer diameter of jacket 36 may be slightly in interference fit with the inner diameter of aperture 24 to provide good electrical connection therebetween.

The match 34 comprises a pair of spaced metal plate electrodes 52 and 54 separated by an insulator 56. Electrodes 52 and 54 are connected at their extended ends to a small diameter wire 58. Pyrotechnic material is formed into a match head 60 over the ends of the electrodes 52 and 54 and wire 58. The match 34 is commercially available. The spacing between terminals 42 and 46 is sufficient to closely receive the match terminals 52 and 54 therebetween. The match terminals may be welded or soldered to the terminals 42 and 46. The detonator 14 is fabricated as an assembly as described above and then assembled to the casing 12.

Figure 3:
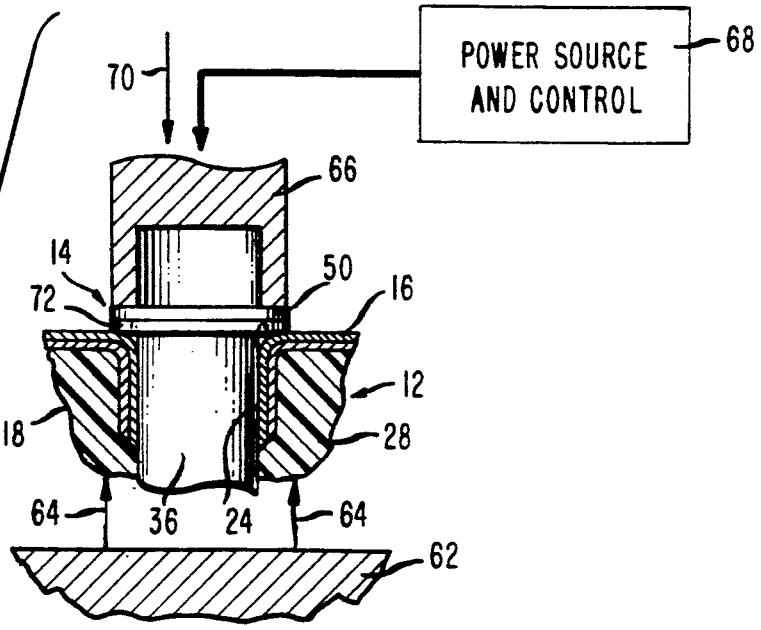
FIG. 3 is a sectional elevation view showing the hermetic sealing of the detonator to the casing.

In FIG. 3, the detonator 14 is assembled to the casing 12 as follows. The casing 12 is supported on a secure support represented by the symbol 62 and arrows 64. The detonator 14 is inserted into the aperture 24 of the casing by an insertion and soldering tool 66. The tool is shown schematically but in practice includes means for releaseably holding the detonator thereto during assembly. The tool 66 is moved under control of a power source and control 68. In practice the detonators may be fed by an automatic feeder to the tool 66 in an automatic assembly system (not shown). The casings may also be fed on an automatic feed system. The tool 66 serves a dual function in providing the insertion force an the direction of arrow 70 and also the heat for soldering the detonator 14 to the cap 16.

A solder washer 72 is assembled to the shaft formed by the jacket 36 prior to insertion of the jacket into the aperture 24. The washer has an outer diameter of about the same as that of the flange 50 of the detonator and is dimensioned to fit over the jacket 36. With the solder washer in place, the tool 66 forces the detonator and washer into engagement with the cap 16. The heat of the tool 66 melts the solder washer while simultaneously squeezes the flange and solder against the cap 16. Pressure is applied for a time to completely melt the solder and form a hermetic joint 74 (FIG. 2) at the interface of the flange 50 with the cap 16. At this time there is no pyrotechnic material inside the cavity of the insert 18.

In FIG. 1, the cavity of insert 18 is then filled with pyrotechnic material 76 via the open end of the insert 18 opposite the detonator 14. A wad of cotton 78 then is placed over the pyrotechnic material 76 filling the rest of the insert cavity. A thermoplastic cap 80 is then heat welded to the end of insert 18. The cap 80 comprises a circular disc 82 from which depend concentric annular inner and outer skirts 84 and 86, respectively. The insert 18 may have a wall thickness of about 35 mils. The outer skirt 86 may have a wall thickness of about 15 mils and the inner skirt 84 may have a wall thickness of about 30 mils. The skirts form a tapered recess therebetween for receiving the end wall of the insert 18 in somewhat interference fit at the edge of the insert. The skirts form a more sharply tapered joint 83 at the interface with the disc 82. This joint spaces the edge of the insert 18 from the disc 82. Skirt 84 has a tapered leading edge facing insert 18 for permitting ease of assembly of the insert between the skirts.

Figure 4:
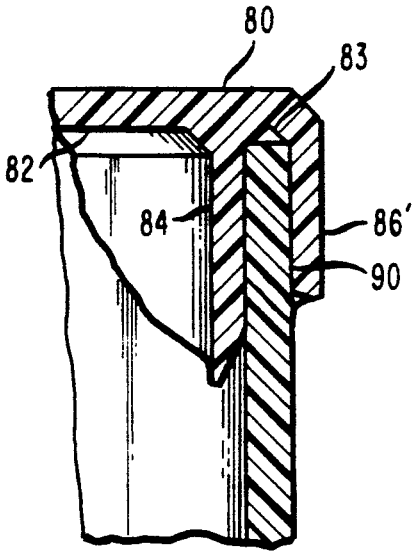
FIG. 4 is a partial sectional elevation view of the device of FIG. 1 showing the heat weld of a thermoplastic end cap to the casing.

A spinning tool 88 (shown dashed FIG. 1) has a circular cylindrical recess having a serrated cylindrical wall 89. The inner diameter of wall 89 is dimensioned to be in interference fit with the outer skirt 86 so as to frictionally grab and force under pressure the skirt 86 outer periphery against the outer surface of the insert 18. The tool 88 spins the gripped cap 80 relative to the casing 12 which is held stationary or vice versa. In FIG. 4, the friction from the spinning action heats the outer skirt 86 and the insert at their interface 90 melting the plastic material and welding the skirt 86 to insert 18. The surfaces of the skirt 86 and insert 18 at their interface 90 may distort somewhat as shown due to the melting action so that some of the insert material flows over the edge of the skirt 86. The tapered joint 83 remains after heat welding. The inner skirt 84 does not heat sufficiently to weld to the insert. The plastic weld joint may reach a temperature of about 350–375 degrees F. However, the inner skirt 84 interface with the insert do not reach the melting temperature and are relatively cooler. The pyrotechnic material, which may be black powder, may have an ignition temperature of about 650–700 degrees F and therefore the heat welding can be performed safely while forming a hermetic seal between the cap 80 and insert 18. While heat welding is preferred other hermetic sealing bonds may be employed between the cap 80 and insert 18 in accordance with a given implementation.

The distance d between the end of the match 34 and the end of the pyrotechnic material is significant. The match head 60 is about centrally positioned within the pyrotechnic material 76 or somewhat off center closer to cap 80. In this position the head when ignited causes ignition of material 76 which burns toward the casing cap 16 as well as toward the cap 80. As a result the material 76 tends to more fully burn than if the ignition were to occur close to cap 16 as would occur in prior art devices in which the detonators are relatively close to the metal cap.

Because the cap 80 is thermoplastic rather than a press fitted metal projectile, such prior art detonators tend to blow the unburned pyrotechnic material out of the casing due to the explosive force created by the initial ignition. By placing the match head about midway into the pyrotechnic material or slightly closer to the cap 80 more uniform burning of the material 76 occurs and thus a bigger flash for a given amount of pyrotechnic material. This flash was in actual tests surprisingly much brighter than anticipated for the given size of the device 10. The resulting flash and smoke was easily observable at several thousand feet distance with a device of about 2 and ½ inches in length and ⅞ inch internal diameter. The distance d is set by making the length of the detonator accordingly since the length of the match 34 is generally more standardized at a given length dimension. Of course, by making the insert different lengths, different flash intensities can be arranged by accommodating more or less pyrotechnic material as desired.

What is claimed is:

1. A pyrotechnic device comprising:

a tubular casing for receiving a pyrotechnic detonator at one end thereof and pyrotechnic material in an interior portion, said casing having a metal cap over said one end;

pyrotechnic material within said casing;

a detonator secured to said metal cap and having a pyrotechnic portion positioned in said interior;

means for hermetically sealing said detonator to said cap; and an end cap hermetically sealed to said casing at an end thereof opposite the one end for hermetically sealing the interior portion from the ambient atmosphere.

2. The device of claim 1 wherein said detonator is metal and is soldered to said metal cap.

3. The device of claim 1 wherein said casing is thermoplastic, said end cap comprising thermoplastic material heat welded to said casing.

4. The device of claim 1 wherein said end cap comprises a disc portion having an annular rim, and first and second spaced concentric juxtaposed skirt portions depending form said disc portion at said rim, a first skirt portion for surrounding the outer surface of said casing at said one end and the other skirt portion for surrounding the inner surface of said casing one end, at least one of said skirts being bonded to said casing.

5. The device of claim 1 wherein said detonator comprises a metal cylindrical body, a first terminal extending from the body, an electrically insulating tube, a tubular metal cylinder having a longitudinal bore, the body being received within the bore of the tube, the tube being received within the bore of the tubular member, and a second terminal extending from the tubular member such that the first and second terminals are juxtaposed in spaced facing relation for receiving therebetween and connection to the terminals of an electrically activated match.

6. The device of claim 1 wherein said detonator comprises a terminal portion secured to the casing, said terminal portion comprising a pair of terminals, said pyrotechnic portion comprising an electrically activated match having spaced terminals connected to the pair of terminals and pyrotechnic material secured to the spaced terminals arranged to be ignited by a current applied to the pair of terminals.

7. The device of claim 6 wherein the pyrotechnic material of said match is positioned in the casing a distance between said casing ends selected such that the match when ignited causes the pyrotechnic material within the casing to ignite in a direction toward said casing one end.

8. The device of claim 1 wherein said detonator is arranged to be electrically activated and is electrically conductively secured to said casing.

9. A pyrotechnic device comprising:

a thermoplastic tubular casing for receiving a pyrotechnic detonator at one end thereof and pyrotechnic material in an interior portion, said casing including a metal cap over the casing at one end thereof;

pyrotechnic material within said casing;

a detonator soldered to the metal cap and forming a hermetically sealed joint with the cap, said detonator including an electrically activated match positioned in contact with said pyrotechnic material; and means for hermetically sealing the end of the casing opposite the one end.

10. The device of claim 9 wherein said means for hermetically sealing said opposite casing end comprises a thermoplastic cap member including an annular disc and at least one annular skirt member depending from and forming with the disc a cylindrical chamber for receiving the casing end opposite the one end, said skirt member being heat welded to said casing.

11. The device of claim 10 wherein said heat weld is formed by spinning the casing relative to said cap member.

12. The device of claim 9 wherein said detonator includes a circular cylindrical body having a first terminal extending axially therefrom, a thermoplastic tube over the body, a metal cylindrical tubular member over the tube and including a second terminal extending juxtaposed with the body terminal, and an electrically activated match having a pair of terminals connected to the first and second terminals and pyrotechnic material connected to said pair of terminals, said body and member having a length such that the pyrotechnic material of the match extends into said casing a selected distance for causing the pyrotechnic material in the casing to burn toward the one end.

13. A pyrotechnic device comprising:

a circular cylindrical thermoplastic casing;

a metal end cap over one end of the casing, said end cap and casing having an aperture at the one end centrally of the end cap;

a circular cylindrical match receiving device in ohmic engagement with and hermetically sealed to the end cap in said aperture and extending into the interior of the casing from the end cap, said match receiving device including a first pair of spaced juxtaposed terminals;

an electrically activated match having a second pair of terminals in contact with first pair of terminals;

pyrotechnic material in said casing in engagement with said match; and a disk-like thermoplastic end cap over the end of the casing opposite the one end heat welded to the casing to form a hermetic seal with the casing at said opposite one end.

14. A pyrotechnic device comprising:

an elongated tubular casing for containing pyrotechnic material, said casing having a longitudinal axis;

a pyrotechnic initiator having a pyrotechnic portion and a terminal portion secured to and hermetically sealed to the casing at one end of the casing;

pyrotechnic material in the casing in contact with the initiator pyrotechnic portion;

means for enclosing and hermetically sealing the other end of the casing; and means for positioning the initiator pyrotechnic portion a distance from said casing one end at least somewhat centrally along said axis.

15. The device of claim 14 wherein said casing includes a metal cap, said initiator is constructed to be electrically activated and is ohmically connected to said casing cap.

16. A method of making a pyrotechnic device comprising;

forming a thermoplastic tubular casing with opposing ends;

attaching a metal end cap with an aperture over one end of the casing:

simultaneously securing a pyrotechnic initiator in ohmic contact with said end cap in said aperture and hermetically sealing the initiator to said end cap;

placing pyrotechnic material in said casing; and hermetically sealing the other end of the casing.

17. The method of claim 16 wherein said hermetically sealing said other end includes heat welding said other end.

18. The method of claim 17 wherein said sealing the other end includes forming a thermoplastic cap, placing the thermoplastic cap over an end of the casing and then spinning one of the casing and thermoplastic cap relative to the other to melt and bond the interface therebetween.

* * * * *